US012429060B2

(12) United States Patent
Lingyu

(10) Patent No.: US 12,429,060 B2
(45) Date of Patent: Sep. 30, 2025

(54) PORTABLE AIR PUMP

(71) Applicant: Hangzhou Juwei Technology Co., Ltd., Hangzhou (CN)

(72) Inventor: Yang Lingyu, Hangzhou (CN)

(73) Assignee: Hangzhou Juwel Technology Co., Ltd., Hangzhou (CN)

( * ) Notice: Subject to any disclaimer, the term of this patent is extended or adjusted under 35 U.S.C. 154(b) by 87 days.

(21) Appl. No.: 18/326,185

(22) Filed: May 31, 2023

(65) Prior Publication Data

US 2024/0401596 A1 Dec. 5, 2024

(51) Int. Cl.
*F04B 53/22* (2006.01)
*F04D 25/06* (2006.01)

(52) U.S. Cl.
CPC ..... *F04D 25/0673* (2013.01)

(58) Field of Classification Search
CPC ..... F04C 15/06; F04C 29/12; F04D 25/0673; F04D 19/002; F04D 17/165; F04D 5/007; F04D 29/4293; F04D 29/60; F04D 29/601; F04D 29/64; F04D 29/644; F04D 29/648; F04D 29/605; F04D 29/70; F04D 29/701; F04D 29/703; F04D 29/708; F04D 25/084; F04D 29/4206; F04D 29/4213; F04D 29/624; F04B 53/22
USPC ..... 417/360
See application file for complete search history.

(56) References Cited

U.S. PATENT DOCUMENTS 2,857,849 A * 10/1958 Pezzillo ..... F04D 29/2255 415/199.2
4,810,173 A * 3/1989 Thomson ..... F23L 5/02 126/25 B
6,092,260 A * 7/2000 Kai ..... B05B 7/2435 239/289
2003/0202890 A1* 10/2003 Bundy ..... F04D 29/5806 417/366
2016/0348675 A1* 12/2016 Ishii ..... F04C 11/001
2018/0023803 A1* 1/2018 Gong ..... F21V 23/06 362/96
2022/0341432 A1* 10/2022 Kataoka ..... F04D 29/542
2024/0093689 A1* 3/2024 Hwang ..... F04D 25/082
2024/0247664 A1* 7/2024 Li ..... F04D 29/02

* cited by examiner

*Primary Examiner* — Essama Omgba
*Assistant Examiner* — Dnyanesh G Kasture

(57) ABSTRACT

The present invention relates to a portable air pump, where such including a housing, which is provided with an air inlet and an air outlet. The housing is provided with centrifugal fan blades, a motor that drives the centrifugal fan blades to rotate, and a battery to power the motor. An air outlet duct is formed between the air inlet and the air outlet, and the motor and battery are built into the air outlet duct. The present invention has the advantages: by setting up an air outlet duct between the air inlet and the air outlet of the housing, and directly embedding the centrifugal fan blades, motor, battery and other drive components into the air outlet duct, the fan blade cavity and the drive cavity are directly connected to form the same duct, and the air flow generated by the air outlet duct is directly used for rapid heat dissipation, which further enhances the heat dissipation effect, and also improves the endurance and performance of the air pump.

7 Claims, 7 Drawing Sheets

PORTABLE AIR PUMP

TECHNICAL FIELD

The present invention relates to a pump, in particular to a portable air pump.

BACKGROUND

There are many consumer items, such as, but not limited to, inflatable cushions, swimming rings, bicycle tires and inflatable beds that require they be inflated with fluid in order to function properly. Conversely, there are many items that need to be efficiently deflated, such as, but not limited to, vacuum storage bags. Typically, users will have the products mentioned above, and others like them, be inflated or deflated manually, which is time-consuming, laborious, and in some cases can be even ineffective. The present invention, a novel electric air pump, is designed and configured to resolve these problems.

In addition to the foregoing consumer needs, many of the consumer air pumps currently on the marketplace are prone to overheating during use. The present invention is also configured to remedy this issue by implementing a unique cooling strategy.

Some of the current art comprises a multifunctional air pump, including an air pump body with a fan blade cavity and a mounting cavity, the air pump body also includes a metal partition plate, the fan blade cavity and the mounting cavity are respectively located on both sides of the metal partition plate, and the air pump body also has an air inlet and an air outlet connected with the fan blade cavity; the multi-function air pump also includes an air charging component with a fan blade and a driving part, the fan blade is installed in the fan blade cavity; and the driving part is mounted in the installation cavity. The fan cavity and the installation cavity of the multi-functional air pump are separated by a metal partition plate, which can better transfer the heat in the installation cavity to the fan blade cavity, and with the flow of air in the fan blade cavity, its heat will be lost, which can help the parts in the installation cavity to dissipate heat to a certain extent. Its disadvantage is: because the inlet and outlet of the multi-function air pump are located on the fan blade cavity, and the heat transfer between the installation cavity and the fan blade cavity is indirectly transferred through the metal partition plate, the heat transfer is limited, which leads to the poor heat dissipation effect of the installation cavity, which needs to be further improved.

SUMMARY

The technical problem to be solved by the present invention is to provide, in view of the current situation of the prior art, a portable air pump wherein the motor and battery are directly embedded into the fan duct to make it dissipate heat rapidly by allowing the air to flow over the motor and battery during operation to take advantage of air cooling. This feature ensures that the device can be used for longer without overheating.

The technical scheme adopted by the present invention to solve the above-mentioned technical problems is an air pump that is characterized in that it comprises a housing, which is provided with an inlet and an outlet. Located within the housing are one or more centrifugal fan blades, a motor that drives the centrifugal fan blades to rotate, and a battery to power the motor. An air outlet duct is formed between the air inlet and the air outlet, and the motor and battery are built into the air outlet duct such that air flowing through the air pump over at least the motor and battery, but in some embodiments may also flow over the fan or other components to facilitate cooling through convection. In many current air pumps on the market they rely on conduction cooling through the use of heat-sinks or similar components. The present invention, in some embodiments, may also utilize heat-sinks but also can improve their efficiency by having them incorporated into the air duct such that the flow of air passes over them.

To mitigate and/or prevent loss of efficiency, in some embodiments the air pump is configured such that the components are located towards the edges or otherwise are streamlined to help ensure that airflow is not inhibited.

In some embodiments, as an option, the air inlet and air outlet are arranged on a substantially coaxial line, and the air outlet duct is substantially straight, where the result of the air outlet duct being arranged in a straight line is that the air flow passes more smoothly, and reduces potential loss of air volume.

In order to better fix the support frame on the rotating shaft, in some embodiments, the air inlet and outlet are both provided with covers, the centrifugal fan blades are connected at the downstream of the air duct of the air inlet cover, and the battery is installed on the air outlet cover. In other embodiments, the fan blades may be installed medially or somewhere along the length of the air duct, with the blades occupying at least some of the duct with a pylon or cross-beam attaching them to the body of the air pump. Some embodiments may feature the battery, motor, fan blades, or other components attached to removable covers, while others may attach them to the interior or exterior of the air duct or housing.

For some examples of the invention, to improve ease of production and assembly, the first housing is mounted on the second housing by fasteners, and the connection between the first housing and the second housing is provided with a sealing ring. Alternatively, in other embodiments the sealing ring may be omitted in favor of a direct seal between the two. The housing may be comprised of a variety of materials, such as, but not limited to, polymers, metals, composites, plastics, or other materials including those yet to be developed. Some embodiments make particular use of substances that are highly convective in order to maximize heat dissipation.

In some embodiments, in order to solve the heat dissipation, further, the first housing may be configured with a heat sink, and the aforementioned motor may be embedded in the heat sink, the output end of the motor is inserted in the centrifugal fan blades and drives the centrifugal fan blades to rotate, the lower end of the air inlet hood is resting on the upper end of the heat sink, the heat sink is built into the aforementioned air outlet duct. In such a configuration, and similar configurations and embodiments, this facilitates moving the air flow over the motor as the air moves through the air duct, assisting with convective heat dissipation.

In order to control the air pump, the housing is provided with a circuit board used to control the motor. The circuit board is built into the aforementioned air outlet duct and is connected to the motor and the battery. The circuit board is provided with on/off buttons, the buttons are arranged on the outer surface of the housing.

For outdoor use, to charge the battery, the outer surface of some embodiments of the housing is also provided with a charging port, which connects the circuit board and the battery. Some examples of the invention may utilize other or additional charging mechanisms, such as, but not limited to, incorporated solar panels, hand cranks, or interchangeable battery ports. Any potential power source could be utilized with the invention provided that it is capable of delivering sufficient power to power the motor.

To make sure the air pump is installed firmly, optionally, the air inlet may be, in some embodiments, further configured with a snap ring, the outer peripheral surface of the snap ring further comprised of a clasp or alternative securing mechanism depending on the needs of the embodiment. The air inlet is, in some configurations, configured with a step surface connected to the clasp, when the snap ring is stuck in the air inlet, the lower end face of the snap ring is against the air inlet cover to limit the upward movement of the air inlet cover, the connection between the air inlet cover and the snap ring is also provided with a positioning portion. The portion includes a positioning groove arranged on the snap ring and a positioning block arranged on the air inlet cover. In other embodiments of the invention, this mechanism may instead comprise a latch that might be twisted into place or have a flange that can be twisted to prevent movement, or alternative locking and latching mechanisms.

Further, the inner wall of the first housing may, in some examples of the invention, be configured with a limit groove along the axis, and the outer peripheral surface of the snap ring and the air inlet cover are respectively configured with a first limit strip and a second limit strip that can be embedded in the limit slot to limit the rotation of the snap ring and the air inlet cover.

In order to improve pump performance, optionally and depending on the needs of the embodiment and situation, the air outlet cover can be disassembled and replaced with a vent, and there are different types of vents that can be placed onto the pump at any time to vary the performance of the air outlet cover. Some vents may direct the air flow in certain ways, while others may inhibit or concentrate the air flow.

The present invention may also be used as a camping lamp or flashlight, further, the air outlet cover can be, in some embodiments, equipped with a light emitting device, wherein the device is configured with a cover, which could be disassembled and mounted on the air outlet cover, and the top of the housing is configured with a hanging ring that can be removed or otherwise moved to permit attachment of the light emitting device.

Compared with the prior art, the present invention has several advantages, which include, but are not limited to: in embodiments where the air inlet and the air outlet of the housing are connected by the air duct, and directly embedding the centrifugal fan blades, motor, battery and other drive components into the air outlet duct, the fan blade cavity and the drive cavity are directly connected to form the same duct, and the air flow generated by the air outlet duct is directly used for rapid heat dissipation, which further enhances the heat dissipation effect, and also improves the endurance and performance of the air pump.

DETAILED DESCRIPTION

Figure 1:
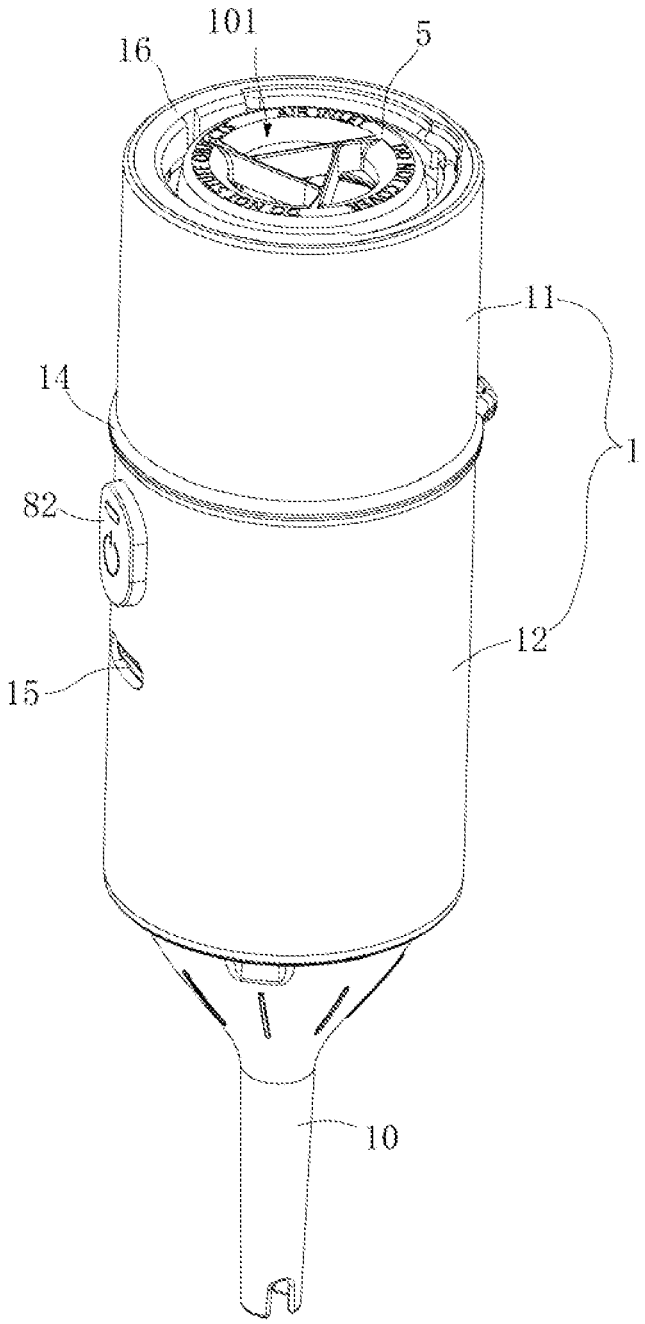
FIG. 1 is a schematic diagram of an air pump, in accordance with an embodiment of the invention.

The present invention will be further described in detail with reference to the accompanying drawings and embodiment.

As shown in FIGS. 1-7, this portable air pump includes a first housing 11, a second housing 12, fasteners 13; centrifugal fan blades 2; motor 3; battery 4; air inlet cover 5; air outlet cover 6; heat sink 7; circuit board 8; snap ring 16; light device 9; vent 10; light device cover 17.

In some embodiments, as shown in FIG. 1, the second threaded hole is arranged on the inner cylinder 17 of the second housing 12. The screw 13 passes through the first threaded hole and the second threaded hole to connect the two together for the housing 1. The connection between the first housing 11 and the second housing 12 is provided with a sealing ring 14. In some examples of the invention, the housing 1 can be integrally formed, no need for a separate structure comprising first housing 11 and second housing 12.

FIG. 1 shows an example of the air pump device, in accordance with an embodiment of the invention. In FIG. 1 we see an air pump device may be comprised of an air inlet 101 which comprises a channel permitting air to flow into the device protected by an air inlet cover 5, wherein the air inlet cover 5 is inserted into an internal cavity of the first housing 11 of the housing 1, and such first housing 11 is connected to the second housing 12 to form the housing 1 via the sealing ring 14. At the opposite end of the second housing 12 may be located the air outlet which is comprised of a channel permitting air to leave the device. In some embodiments, the flow of air may be reversed, thus reversing the role of air inlet 101 and air outlet 102. Some embodiments of the invention may be further comprised of a charging port 15, wherein a power source or recharging source may plug into the device to ensure a consistent flow of power. The device may, in some examples, also be configured with a pressing portion 82 of a switch button, configured to activate the device.

Figure 2:
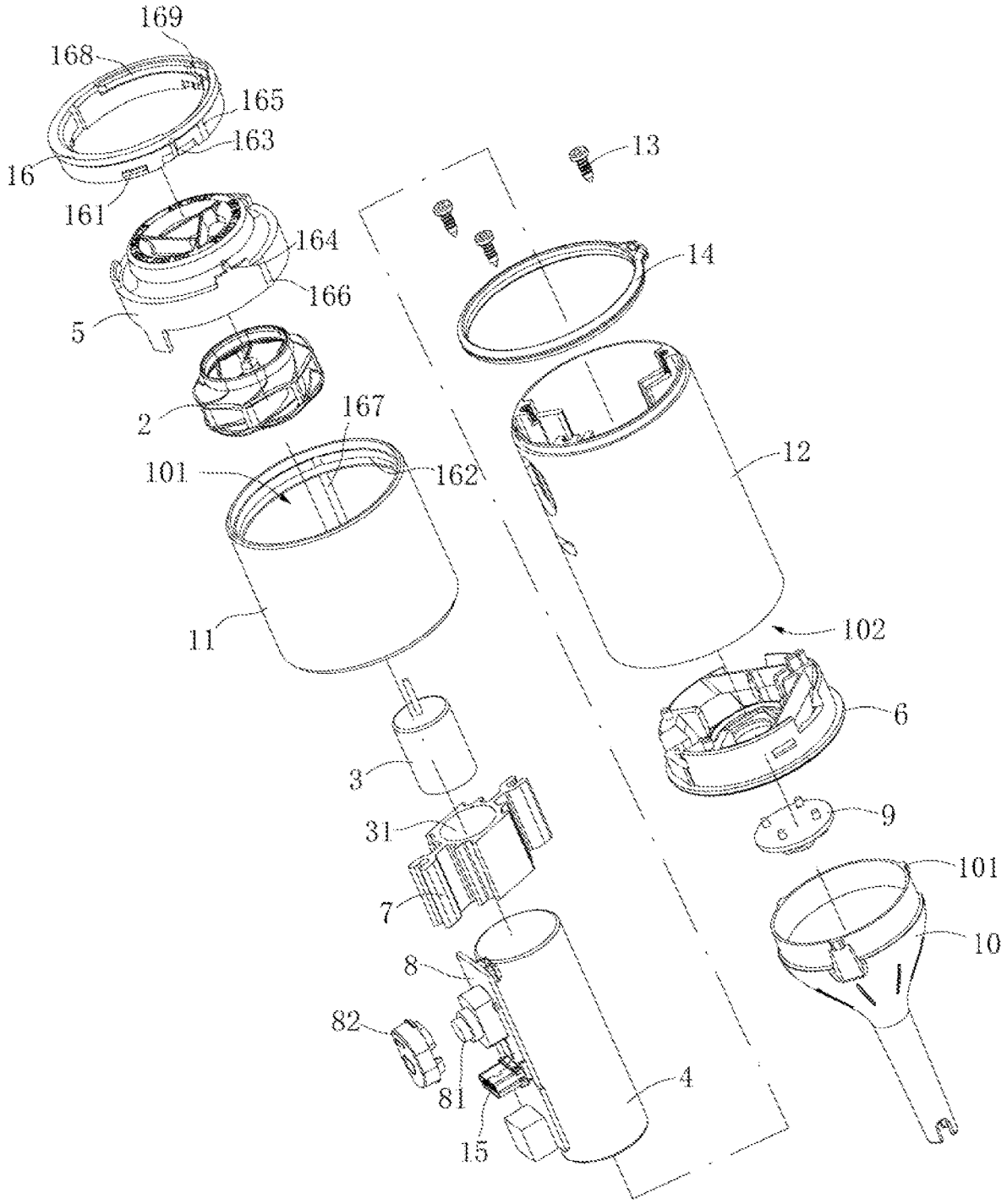
FIG. 2 is a three-dimensional schematic diagram of an air pump, in accordance with an embodiment of the invention.

As shown in FIG. 2 for some examples of the invention, the upper end of the first housing is provided with an air inlet 101 and the lower end of the second housing is provided with outlet 102, wherein the air inlet 101 and the air outlet 102 are arranged on the same axis. A straight cylinder-shaped air outlet duct will be formed when the air inlet 101 and air outlet 102 are connected. The centrifugal fan blades 2, motor 3, battery 4 may be arranged sequentially in the first housing 11 and the second housing 12 from top to bottom or in such other arrangement as is needed by the embodiment. Motor 3 drives the centrifugal fan blades 2 to rotate, and battery 4 supplies power to motor 3 (see FIG. 3). The air outlet duct is formed between the air inlet 101 and the air outlet 102. The motor 3 and battery 4 may be built into the air outlet duct, the air inlet cover 5 may be arranged in the air inlet 101; the air outlet cover 6 may be arranged in the air outlet 102; the centrifugal fan blades 2 may be connected to the air inlet 5 downstream of the air duct, the battery 4 may be installed on the air outlet cover 6.

FIG. 2 further demonstrates an embodiment of the invention wherein the embodiment is further comprised of a sealing ring 14 configured to keep the housing 1 components coupled together. Similarly, at the end of such an embodiment may be a snap ring 16 configured to removably couple to the air inlet cover 5 wherein the snap ring 16 is comprised of a positioning groove 163 that fits into a positioning block 164 of the air inlet cover 5, wherein the snap ring 16 is also comprised with a first limit strip 165 that corresponds to a second limit strip 166 of the air inlet cover 5. The snap ring 16 may also be comprised of a groove 169 and hanging ring 168, wherein the latter is configured to allow the invention to hang from a hook or similar holder. Lastly, the snap ring 16 may be further comprised of a clasp 161 intended to assist with insertion or removal. The first housing 11 may also have a limit groove 167 designed to prevent the air inlet cover 5 from rotating. A central space of the first housing 11 may also be configured as an air inlet 101, allowing air to move from the air inlet cover 5 into such a space.

FIG. 2 also demonstrates the actuation mechanism attached to the battery 5, wherein the circuit board 8 is attached thereto and further comprises a charging port 15, a switch button 81, and a pressing portion of the switch button 82, wherein pressing such switch button 82 can activate or deactivate the device by allowing power to flow from the battery 5 to the motor 3.

Some examples of the invention, as shown in FIG. 2, in some embodiments the inner wall of the first housing 11 may be comprised of a limit groove 167 along the axis; and the outer circumference of the snap ring 16 and the air inlet cover 5 are respectively comprised, in some examples, of a first limit strip 165 and a second limit strip 166 that can be embedded in the limit groove 167 so as to potentially limit the rotation of the snap ring 16 and the air inlet cover 5, making the installation of the snap ring 16 and the air inlet cover 5 more secure.

Figure 3:
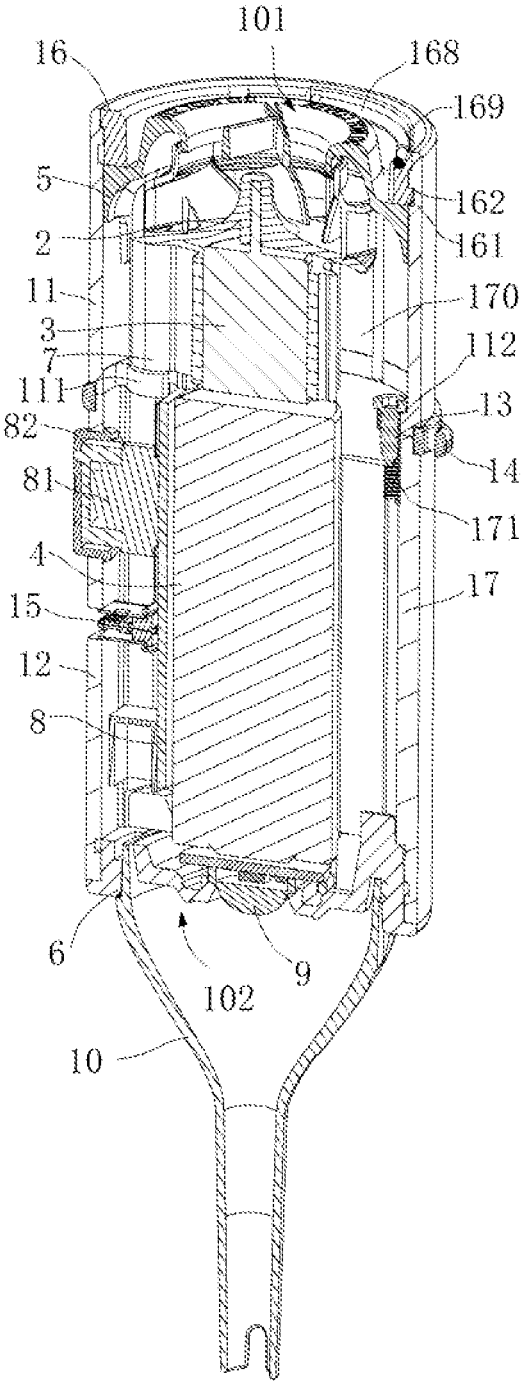
FIG. 3 is a cross-sectional view of an air pump, in accordance with an embodiment of the invention.

As shown in FIG. 3, a heat sink 7 may be mounted at the bottom of the first housing 11 but may also be located in other places depending on the needs of the embodiment in question; the bottom of the first housing 11 may be comprised of a mounting platform 111; the middle of the heat sink 7 may be comprised of a mounting hole 71; the motor 3 may be embedded in the mounting hole 71 so that the heat sink 7 and the motor 3 would, in some embodiments, be fixed together; the output end of the motor 3 may be arranged upward and inserted on the centrifugal fan blades 2 so that it can drive the centrifugal fan blades 2 to rotate; and the lower end of the air inlet cover 5 may be connected with the upper end of the heat sink 7; the snap ring 16 may be arranged above the air inlet cover 5; the outer peripheral surface of the snap ring 16 may be comprised of a clasp 161; the air inlet 101 of the first housing 11 is comprised of a step surface 162 that is clamped to each other with the clasp 161. When the snap ring 16 is clamped in the air inlet 101, the lower end surface of the snap ring 16 may rest against the air inlet cover 5 to prevent the air inlet cover 5 from moving upward; the connection between the air inlet cover 5 and the snap ring 16 may be comprised of a positioning portion positioned to each other, the positioning portion comprises, in some embodiments, a positioning groove arranged on the snap ring 16 and a positioning block arranged on the air inlet cover. In some examples, extending from the inner cylinder 17 of the second housing 12 to the air outlet 102; the upper end of the air outlet cover 6 may match with the lower end of the cylinder 17; since the lower end of the air outlet cover 6 and the second housing 12 may be installed in the same way as the first housing 11 and the air inlet cover 5, which may also be joined with a clasp.

In some embodiments, as shown in FIG. 3, the housing 1 may be comprised of a circuit board 8 that can be configured to control the motor 3, wherein the circuit board 8 may be built into the air outlet duct 170, and the motor 3 and the battery 4 may be connected, and the circuit board 8 may, depending on the needs of the embodiment, be further configured with a switch button 81. The pressing portion 82 of the switch button 81 may be exposed to the outer side of the housing 1, and the outside of the housing 1 may be comprised of a charging port 15. The charging port 15, depending on the needs of the embodiment, may connect the circuit board 8 and the battery 4, or such other configuration as appropriate. In some embodiments, the device may be powered by an alternative source, such as, but not limited to, a cord configured to plug into a conventional outlet. At the end of the process, the air is directed out of the invention housing through air outlet 10.

As demonstrated in FIG. 3, some embodiments may also be comprised of a hanging ring 168 and a groove 169 wherein the groove 169 is configured to be a receptable to store the hanging ring 168 when not in use, while the hanging ring 168 can fold out to create a means by which to hang the device from a hook or similar fastener.

FIG. 3 also demonstrates an embodiment with a mechanism to affix the components of the housing, wherein screw 13 passes through the first threaded hole and the second threaded hole 171 to connect the two together for the housing 1.

Figure 4:
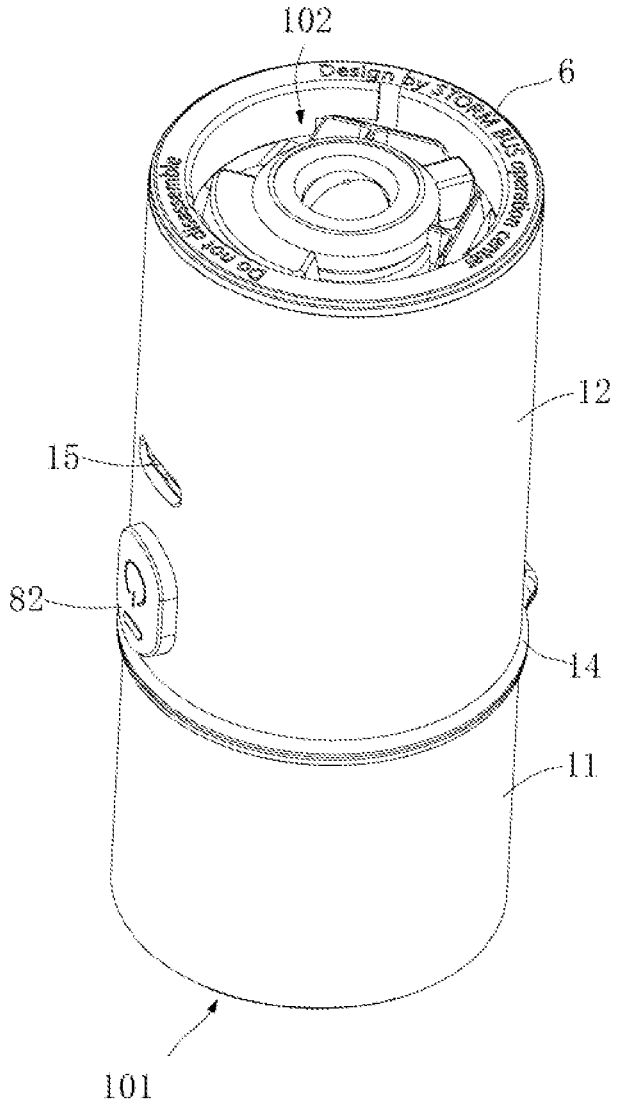
FIG. 4 is a schematic diagram of an air pump with the vent component removed, in accordance with an embodiment of the invention.

FIG. 4 is a schematic diagram of an air pump with the vent component removed, in accordance with an embodiment of the invention, wherein we view the device from the bottom. In such embodiments, we see the first housing 11 connected to the second housing 12 by the sealing ring 14. Air proceeds into the inner space of first housing 11 through the air inlet 101, though the opening itself is not visible in FIG. 4. The air then flows through the first housing 11 and second housing 12, and then exits via air outlet 102 and through the air outlet cover 6. Also visible in FIG. 4 is the charging port 15, which allows the user to charge the battery, and the pressing portion 82 of the switch button, which directs the circuit board to turn on or off the motor.

Figure 5:
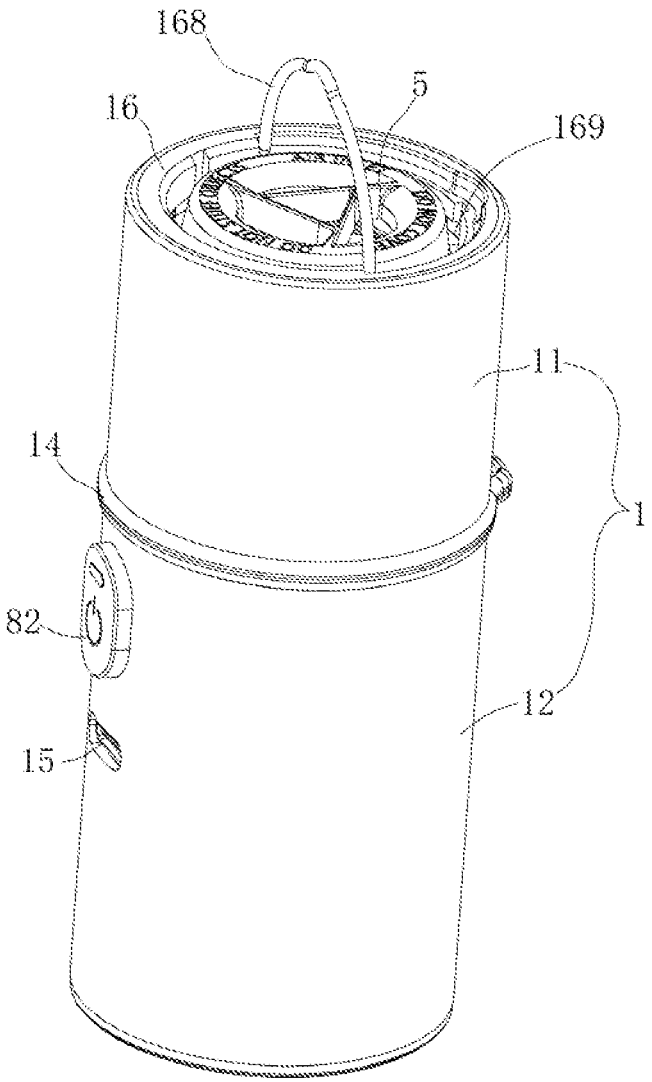
FIG. 5 is a schematic diagram of an air pump with the hanging ring lifted, in accordance with an embodiment of the invention.

As shown in FIG. 5, the snap ring 16 may be configured with a hanging ring 168 that can be movable, and a groove 169 that can be placed after the ring is folded. When the ring 168 is lifted, it can be hung to store the device, or, if it is in the illumination configuration, used to illuminate an area without needing to be held by a user. Considering the air pump is frequently utilized for outdoor use, it is often seen as a camping gear. The light device arranged at the bottom of the pump, in some embodiments, is for outdoor lighting, when removing the light device cover, a flash of light is emitted. Equipped with the light device cover 17, light may be emitted depending on the configuration of the light component such as, but not limited to, the wattage of its bulb, making the bottom of the entire air pump, in some configurations, a bulb that glows on the entire surface. In the outdoor tent, the light will become softer and offer a warm atmosphere. Also demonstrated in FIG. 5 is the housing 1, which is comprised of the first housing 11 and the second housing 12. They are joined together by the sealing ring 14. Also visible in FIG. 5 is the charging port 15, which allows the user to charge the battery, and the pressing portion 82 of the switch button, which directs the circuit board to turn on or off the motor.

Figure 6:
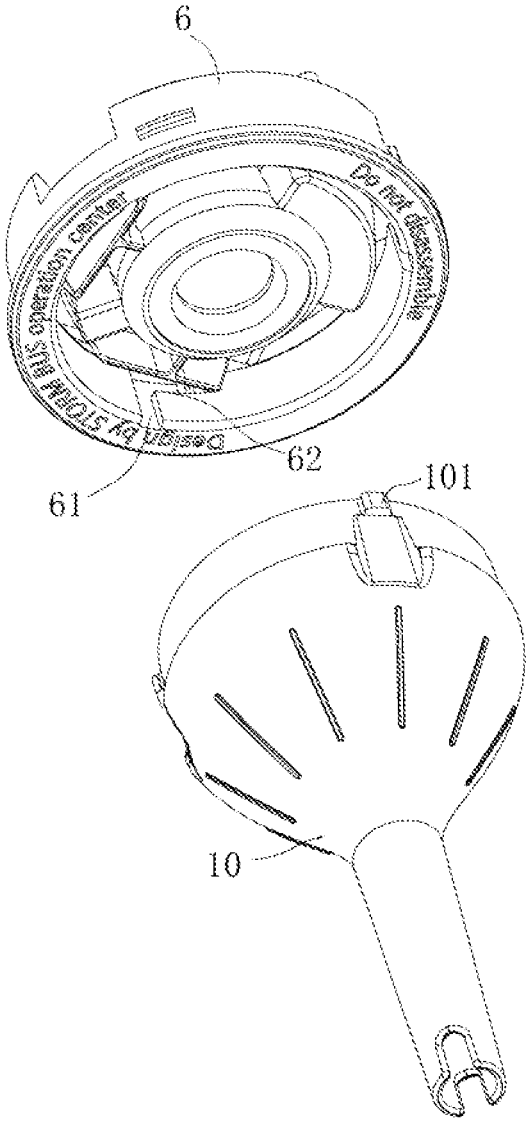
FIG. 6 is a schematic diagram of the installation structure for the vent and the air outlet cover, in accordance with an embodiment of the invention.

As shown in FIG. 6, the air outlet cover 6 may be comprised of a vent 10; the vent 10 may be comprised of a wedge 101; the air outlet cover 6 may be comprised of corresponding slot 61, and the bottom of the slot 61 may extend horizontally with a retaining slot 62. In such embodiments, when the wedge 101 is inserted into the bottom of the slot 61, the air outlet 10 may be rotated so that the wedge 101 is rotated into the retaining slot 62, so that the wedge 101 is limited to the slot 61, so that the air outlet 10 is fixed to the air outlet cover 6, and can be quickly disassembled at any time, and different types of air outlet 10 can be replaced at any time, which can be used to inflate more equipment. In some embodiments, this configuration may be utilized to allow for a variety of air outlet covers to be used so that the device can be inserted into a variety of different types of inflatable devices (or devices in need of rapid deflation).

Figure 7:
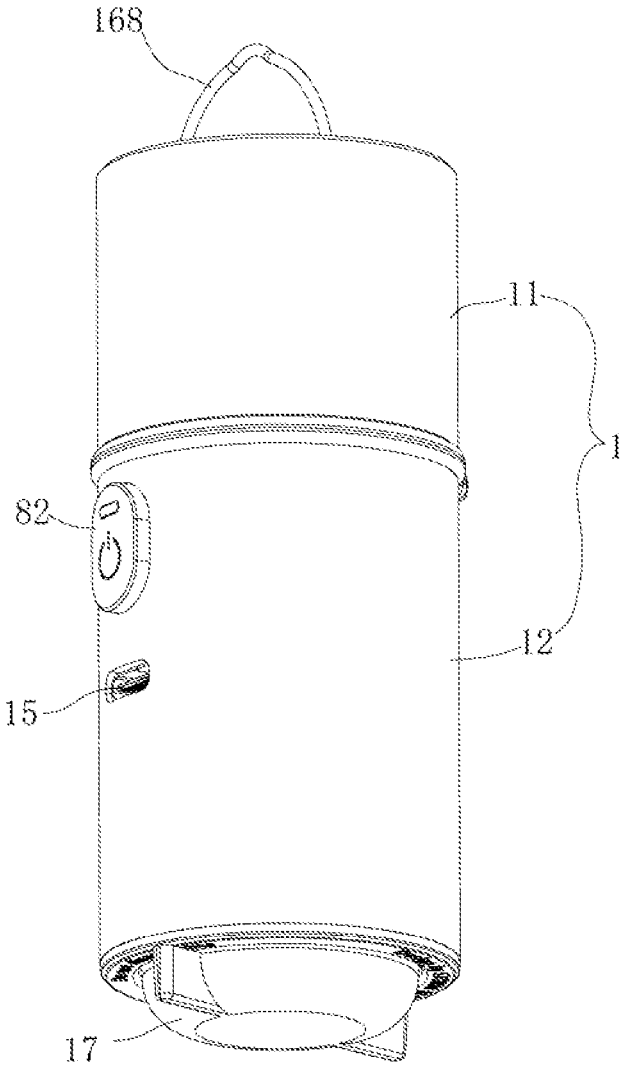
FIG. 7 is a schematic diagram of an air pump with a lighting device cover attached, in accordance with an embodiment of the invention.

As shown in FIG. 7, when the air pump is not in its inflation/deflation configuration, it can also be used as an outdoor camping light or flashlight, by adding an illuminator component. The device may be further comprised of light device 9 that attached on the air outlet cover 6, and a removable transparent or frosted light device cover 17 may be added to the outside of the light device 9; in such a configuration, the light device cover 17 and air outlet cover 6 are installed in the same way as air outlet 10 and air outlet cover 6. Also visible in FIG. 7 is the charging port 15, which allows the user to charge the battery, and the pressing portion 82 of the switch button, which directs the circuit board to turn on or off the motor.

The principle of heat dissipation of the air pump is as follows: After the wind is sucked in by the negative pressure formed by the centrifugal fan blades 2 from top to bottom from the air inlet 101, it passes through the motor 3, heat sink 7, battery 4, circuit board 8, and finally comes out from the air outlet 102. Since the motor 3, battery 4, circuit board 8 and other components are all built into the air duct, in some embodiments, the heat dissipation effect of each component is optimized, thereby enhancing the battery life and performance of the air pump. This feature allows the device to function as its own supplemental cooling system.

What is claimed is:

1. A portable air pump, wherein the portable air pump comprises a housing, comprised of an air inlet and an air outlet, wherein the housing encloses:

one or more centrifugal fan blades, a motor configured to rotate the one or more centrifugal fan blades, a battery that is electrically connected to the motor and supplies power to the motor arranged in sequence inside the housing;

and an air outlet duct that is formed between the air inlet and the air outlet, and wherein the motor and the battery are coupled to an interior of the air outlet duct;

wherein the air inlet further comprises an air inlet cover, and the air outlet further comprises an air outlet cover, and the one or more centrifugal fan blades are connected downstream of an air duct of the air inlet cover, and the battery is coupled to the air outlet cover and the air inlet further comprises a snap ring, and an outer peripheral surface of the snap ring is comprised of a clasp, the air inlet further comprises a step surface coupled to the clasp, such that when the snap ring is fixed to the air inlet, a lower end surface of the snap ring rests against the air inlet cover to prevent the air inlet cover from moving upward, and a connection between the air inlet cover and the snap ring is configured with adjacent positioning portions and the positioning portions further comprise a positioning groove arranged on the positioning portion of the snap ring and a positioning block arranged on the positioning portion of the air inlet cover; and wherein an inner wall of the first housing portion is further configured with a limit groove along an axis, and the outer peripheral surface of the snap ring and the air inlet cover comprises a first limit strip and a second limit strip configured to be embedded in the limit groove to limit rotation of the snap ring and the air inlet cover.

2. The portable air pump of claim 1, wherein an axis of the air inlet coincides with an axis of the air outlet, and the air outlet is substantially straight and substantially cylindrical.

3. The portable air pump of claim 1, wherein the housing further comprises a first housing portion and a second housing portion, and the first housing portion is coupled to the second housing portion by fasteners, and the first housing portion and the second housing portion are coupled together with a sealing ring.

4. The portable air pump of claim 3, wherein the first housing portion further comprises a heat sink, the motor is coupled to the heat sink, a lower end of an air inlet cover rests on an upper end of the heat sink, and the heat sink is coupled to an interior of the air outlet duct.

5. The portable air pump of claim 4, wherein the housing further comprises of a circuit board configured to control the motor, wherein the circuit board is incorporated inside the air outlet duct, wherein the circuit board is configured with a switch button, and a pressing portion of the switch button is exposed to an outside of the housing, the outside of the housing is configured with a charging port, and the charging port is electrically connected to the circuit board and the battery and configured to charge the battery.

6. The portable air pump of claim 1, wherein the air outlet cover is further comprises a vent.

7. The portable air pump of claim 1, wherein the air outlet cover comprises a light device, an outer circumference of the light device comprises a tight device cover, and the light device cover can be detachably mounted on the air outlet cover, and the top of the housing is configured with a movable hanging ring.

* * * * *